US006971250B1

(12) United States Patent
Imre et al.

(10) Patent No.: US 6,971,250 B1
(45) Date of Patent: Dec. 6, 2005

(54) FREEDOM FRIDGE DEVICE

(76) Inventors: John J. Imre, 1030 Pumphouse Rd. Apt. No. 1, Chippewa Falls, WI (US) 54729; Jerome E. Johnson, Jr., 8425 720th Ave., Elk Mound, WI (US) 54739; Michael Cropp, N 6643 250th St., Menomonie, WI (US) 54751

( * ) Notice: Subject to any disclaimer, the term of this patent is extended or adjusted under 35 U.S.C. 154(b) by 0 days.

(21) Appl. No.: 11/005,730

(22) Filed: Dec. 6, 2004

Related U.S. Application Data

(60) Provisional application No. 60/527,516, filed on Dec. 8, 2003.

(51) Int. Cl.[7] ..... F25D 11/02
(52) U.S. Cl. ..... 62/441; 312/406
(58) Field of Search ..... 62/246–256, 440–441; 312/114–140, 401–407

(56) References Cited

U.S. PATENT DOCUMENTS 3,769,805 A * 11/1973 Corini ..... 62/3.6
3,841,109 A * 10/1974 Cann ..... 62/266
4,314,458 A * 2/1982 Hade et al. ..... 62/256
4,642,999 A * 2/1987 Justice ..... 62/440
4,850,658 A * 7/1989 Sandor ..... 312/225
4,920,760 A * 5/1990 Muhlack ..... 62/255
5,056,332 A * 10/1991 Tajima et al. ..... 62/252
5,458,407 A * 10/1995 Bustos et al. ..... 312/116
5,536,081 A * 7/1996 Pokhis ..... 312/321.5
5,868,476 A * 2/1999 Samborn et al. ..... 312/125
6,539,740 B1 * 4/2003 Santana, Jr. ..... 62/255
6,715,308 B2 * 4/2004 Grimm et al. ..... 62/246

* cited by examiner

*Primary Examiner*—William E. Tapolcai
(74) *Attorney, Agent, or Firm*—Tipton L. Randall

(57) ABSTRACT

A refrigeration device includes a refrigeration compartment with planar, horizontal top and bottom portions and vertical sidewall portion. The compartment has an elliptical cross-section and is supported by a vertical support member. The compartment includes at least two separate, planar shelving members positioned adjacent the compartment bottom portion, with each shelving member rotatable about a separate vertical axis. The compartment's sidewall portions each includes at least one door member providing access to the planar shelving members. The compartment's sidewall end portions includes a pair of door members that slide horizontally to provide access to the planar shelving members interior the refrigeration compartment. Most preferably, the door members are transparent. A refrigeration unit supplies cooling air to the refrigeration compartment for cooling items therein.

54 Claims, 14 Drawing Sheets

FREEDOM FRIDGE DEVICE

CROSS-REFERENCE TO RELATED APPLICATIONS, IF ANY

This application claims the benefit under 35 U.S.C. §119 (e) of co-pending provisional application Ser. No. 60/527,516, filed 8 Dec., 2003. Application Ser. No. 60/527,516 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a refrigeration device and, more particularly, to a refrigeration device adapted for use by elderly or physically disabled individuals.

2. Background Information

The state of the art includes various devices for refrigerating perishable items. This technology is believed to have significant limitations and shortcomings, including but not limited to that the devices require extensive energy usage, and access to the refrigeration device is, at best, difficult for elderly or physically disabled individuals, particularly those confined to a wheel chair.

For this and other reasons, a need exists for the present invention. This invention provides a unique refrigeration device which is readily accessible by all individuals, regardless of age or physical limitation, which is believed to fulfill the need and to constitute an improvement over the background technology.

All United States patents and patent applications, and all other published documents mentioned anywhere in this application are incorporated by reference in their entirety. Some examples of refrigeration devices for which patents have been granted include the following.

One applicant has disclosed a refrigeration system using coldambient sources in U.S. Pat. No. 5,720,182. The apparatus is composed of a vacuum panel insulated cabinet containing six mirrored cylindrical compartments served by transparent sliding doors. The internal space of the compartments is divided by a rotating disc shelf, as well as steel rods positioned through the axis shaft of the disc at right angles. The compartments are cooled with water passing through water jackets that surround them, being precooled by having the water coarse through an ice water bath via a coiled and finned tube in a covered container. Cold air can also be used directly from outdoors to cool the compartments. A remotely powered cooler is held in reserve. In automatic defrost models, the apparatus is integrated with the household hot water plumbing. Although the disclosed system provided significant advancement over existing refrigeration systems, improvements in various features of the disclosed system are possible.

Applicants have devised a refrigeration device which retains many of the desirable features of the above-described refrigeration system, and incorporates a number of novel features which provide significant improvements over the existing technology.

SUMMARY OF THE INVENTION

The invention is directed to a refrigeration device. The device includes a refrigeration compartment with planar, horizontal top and bottom portions and vertical sidewall portion. The compartment has an elliptical cross-section and is supported by a vertical support member. The refrigeration compartment's vertical sidewall portion includes opposed, curved end sections and opposed, essentially planar, side sections. The refrigeration compartment includes two separate, planar, first shelving members positioned adjacent the compartment bottom portion, with each first shelving member rotatable about a separate vertical axis. Each of the sidewall's side sections includes at least one door member each providing access to the two separate, planar first shelving members. The sidewall curved end sections each include a pair of curved, sliding door members, with each sliding door member providing access to one of the two separate, planar, first shelving members. Preferably, the door members are transparent. A powered refrigeration unit, that includes a compressor system with refrigeration fluid circulating through an evaporator cooling section and a condenser section, provides cooling for the refrigeration compartment.

DESCRIPTION OF THE EMBODIMENTS

Nomenclature

10 Refrigeration Device
15 Refrigeration Compartment
20 Top Portion of Compartment
25 Bottom Portion of Compartment
30 Vertical Sidewall Portion of Compartment
35 Sidewall Curved End Sections
40 Rotatable First Shelving Members
45 Rotatable Second Shelving Members
50 Sidewall Opposed Side Sections
55 Planar Hinged Door Members
60 Planar Sliding Door Members
65 Door Seal Members
70 Tracks for Sliding Door Members
75 Sidewall Curved Sliding Door Members
80 Freezer Compartment
85 Vertical Sidewall of Freezer Compartment
90 Curved End Section of Freezer Compartment Sidewall
95 Curved Freezer Door Member
100 Powered Refrigeration Unit
105 Compressor System of Refrigeration Unit
110 Evaporator Cooling Section
115 Condenser Section
120 Housing for Refrigeration Unit
125 Cold Air Conduit of Refrigeration Compartment
130 Return Air Conduit of Refrigeration Compartment
140 Rod Members Between First and Second Shelving Members
145 Circular Support Member for Second Shelving Member
150 Slidable Clip Members
155 Adjustable Shelf Members
160 Extendible Shelf Member
165 Support Leg for Shelf Member
200 Vertical Support Member
205 Telescoping Structure of Support Member
210 Linear Actuator
215 Electric Motor
220 Screw Drive Assembly Construction The refrigeration device of the present invention includes a refrigeration compartment with planar, horizontal top and bottom portions and vertical sidewall portion. The refrigeration compartment has an elliptical cross-section and is supported by a vertical support member with a cross-section smaller than the refrigeration compartment's elliptical cross-section. The refrigeration compartment includes a vertical sidewall having opposed, curved end sections and opposed, essentially planar, side sections. The refrigeration compartment includes two separate, planar, first shelving members positioned adjacent the compartment's bottom portion, with each first shelving member rotatable about a separate vertical axis. Each of the sidewall's side sections includes at least one door member each providing access to the two separate, planar first shelving members. The sidewall curved end sections each include a pair of curved, sliding door members, with each sliding door member providing access to one of the two separate, planar, first shelving members. Most preferably, the doors of the refrigeration compartment are transparent for viewing items contained within the compartment. A powered refrigeration unit, that includes a compressor system with refrigeration fluid circulating through an evaporator cooling section and a condenser section, provides cooling for the refrigeration compartment. A vertical support member is secured to the refrigeration compartment for positioning the refrigeration compartment a selected distance above a support surface.

Figure 1:
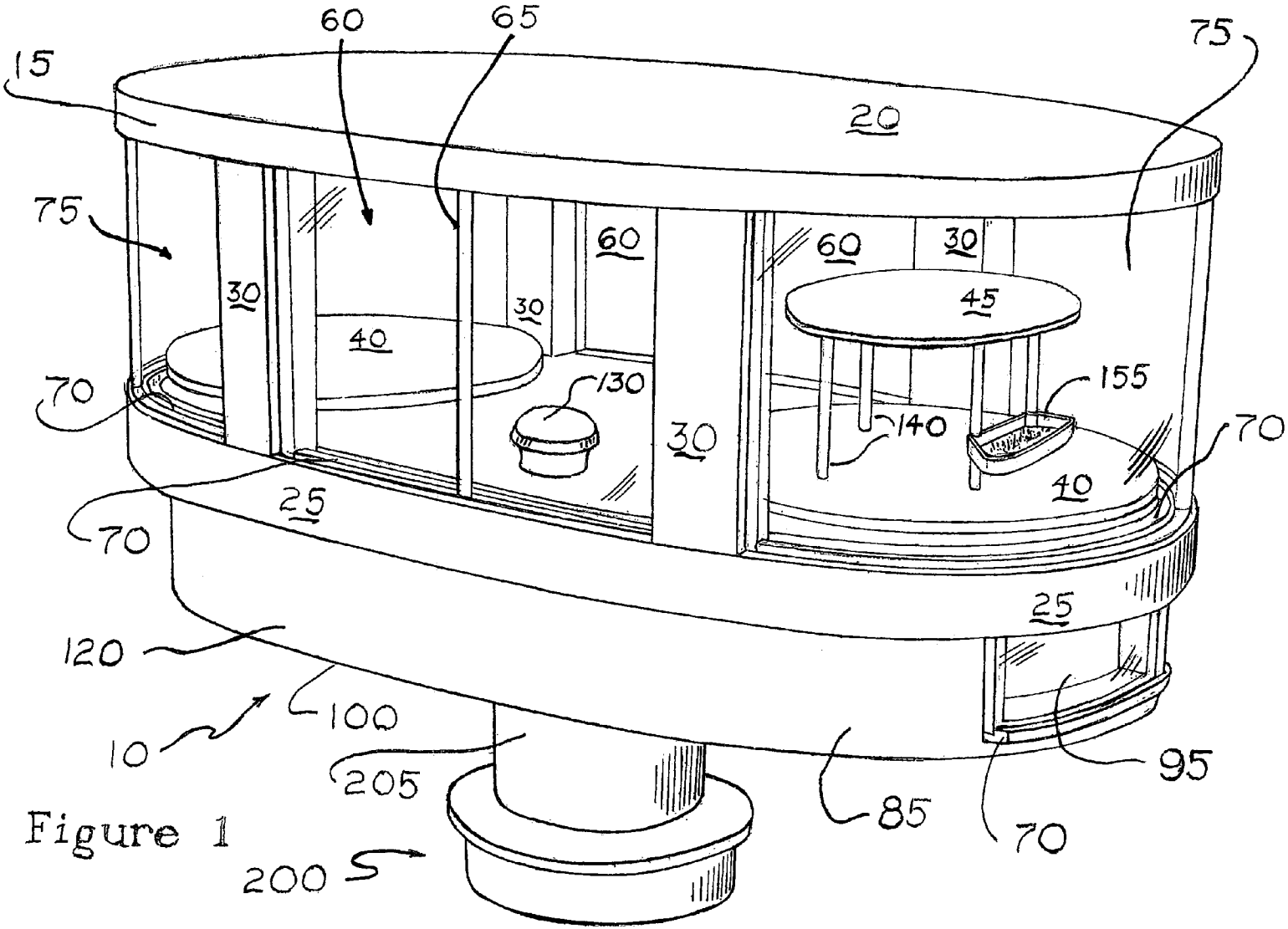
FIG. 1 is a perspective view of one embodiment of the refrigeration device of the present invention.
Figure 2:
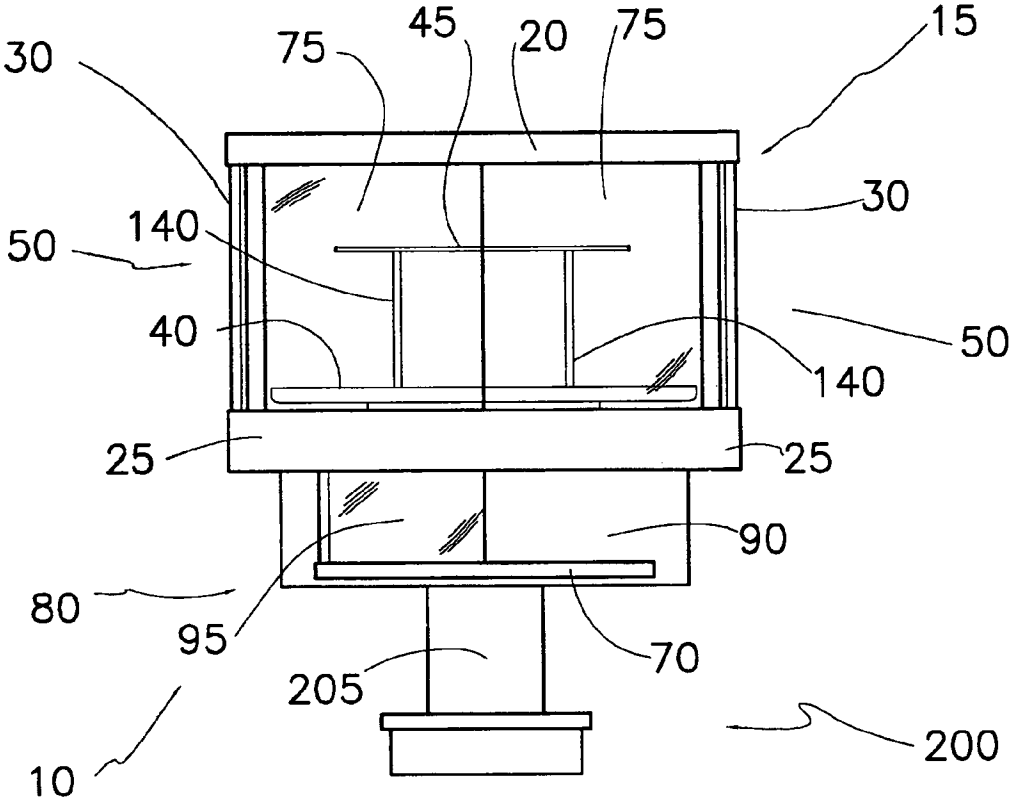
FIG. 2 is an end view of the one embodiment of FIG. 1 of the refrigeration device of the present invention.
Figure 3:
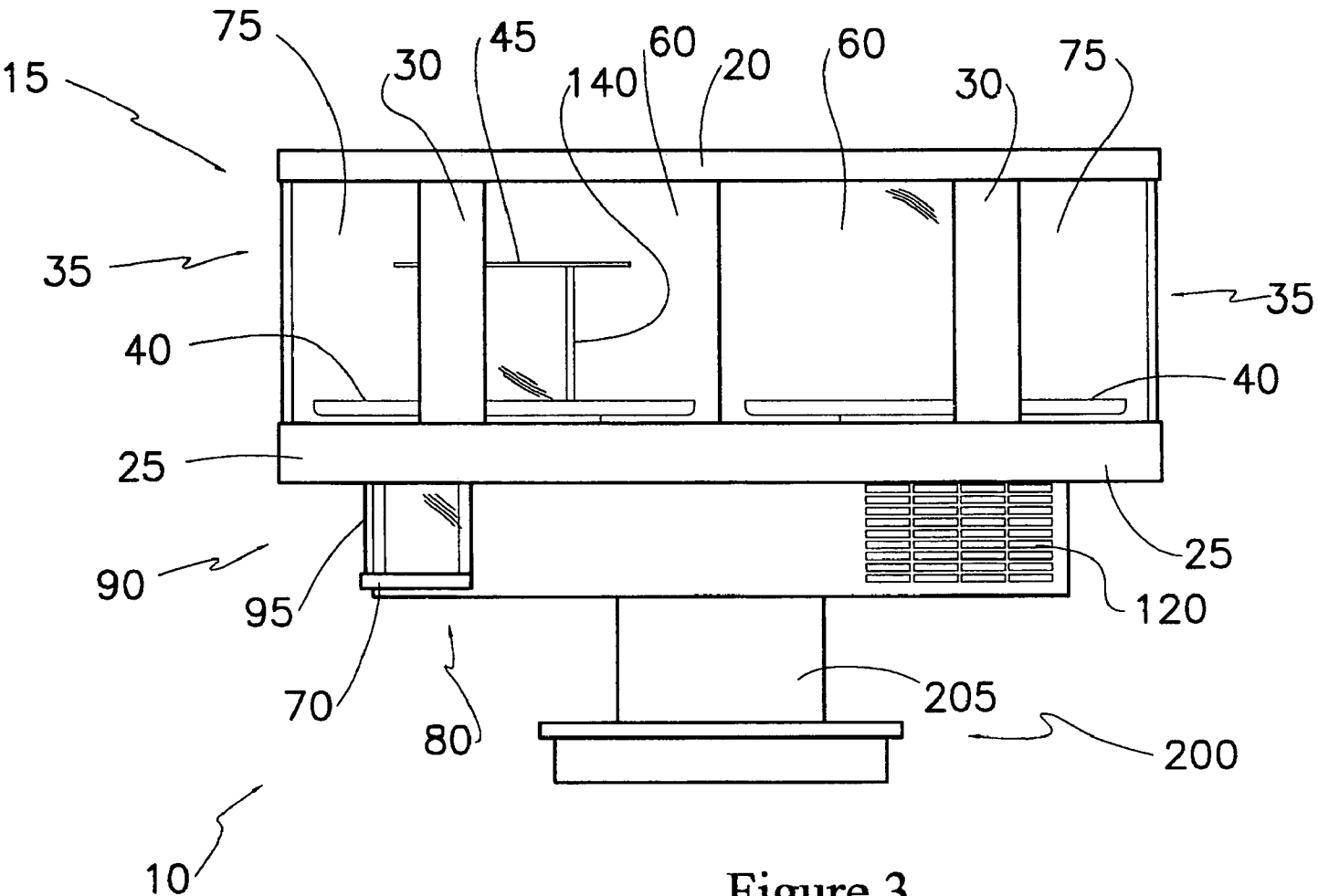
FIG. 3 is a side view of the embodiment of FIG. 1 of the refrigeration device of the present invention.

Referring to FIGS. 1–3, one embodiment of the refrigeration device 10 of the present invention is shown. The device 10 includes a refrigeration compartment 15 with planar, horizontal top portion 20 and a planar, horizontal bottom portion 25 and a vertical sidewall portion 30, connecting the top portion 20 and the bottom portion 25. The refrigeration compartment 15 has an elliptical cross-section and is supported by a vertical support member 200 with a cross-section smaller than the refrigeration compartment's 15 elliptical cross-section. The smaller vertical support member 200 provides for close approach of an individual in a wheel chair to the refrigeration compartment 15 without interference by the vertical support member 200. The vertical sidewall 30 includes opposed, curved end sections 35 and opposed, essentially planar, side sections 50.

The refrigeration compartment 15 contains two separate, planar, first shelving members 40 positioned adjacent the compartment's bottom portion 25, with each first shelving member 40 rotatable about a separate vertical axis. Preferably, the first shelving members 40 are circular in shape, with each first shelving member 40 positioned adjacent an end of the elliptical refrigeration compartment 15. In a further embodiment of the invention, a rotatable, planar, second shelving member 45 is positioned in register above each planar, first shelving member 40, with each second shelving member 45 rotatable about the vertical axis of rotation of the first shelving member 40 there beneath. Most preferably, the second shelving members 45 are also circular in shape. In this further embodiment of the invention, a plurality of vertical rod members 140 extends between each first shelving member 40 and second shelving member 45 to support the second shelving member 45. Preferably, the vertical rod members 140 are rigidly secured at one end to the first shelving member 40 and at an opposite end to a circular support 145 fitted with rollers (not shown), which provide independent movement of the second shelving member 45 relative to the first shelving member 40. The vertical rod members 140 also provide points of attachment for adjustable shelving members 155, described in detail below.

Referring again to FIGS. 1–3, the refrigeration compartment's sidewall portion 30 provides structural support for separating the compartment's top portion 20 from the bottom portion 25. The refrigeration compartment's top portion 20, bottom portion 25 and sidewall portion 30 include smooth exterior surfaces with an insulating material therein. Thus, the refrigeration compartment 15 presents a smooth, easily cleaned, interior surface and exterior surface.

Figure 4:
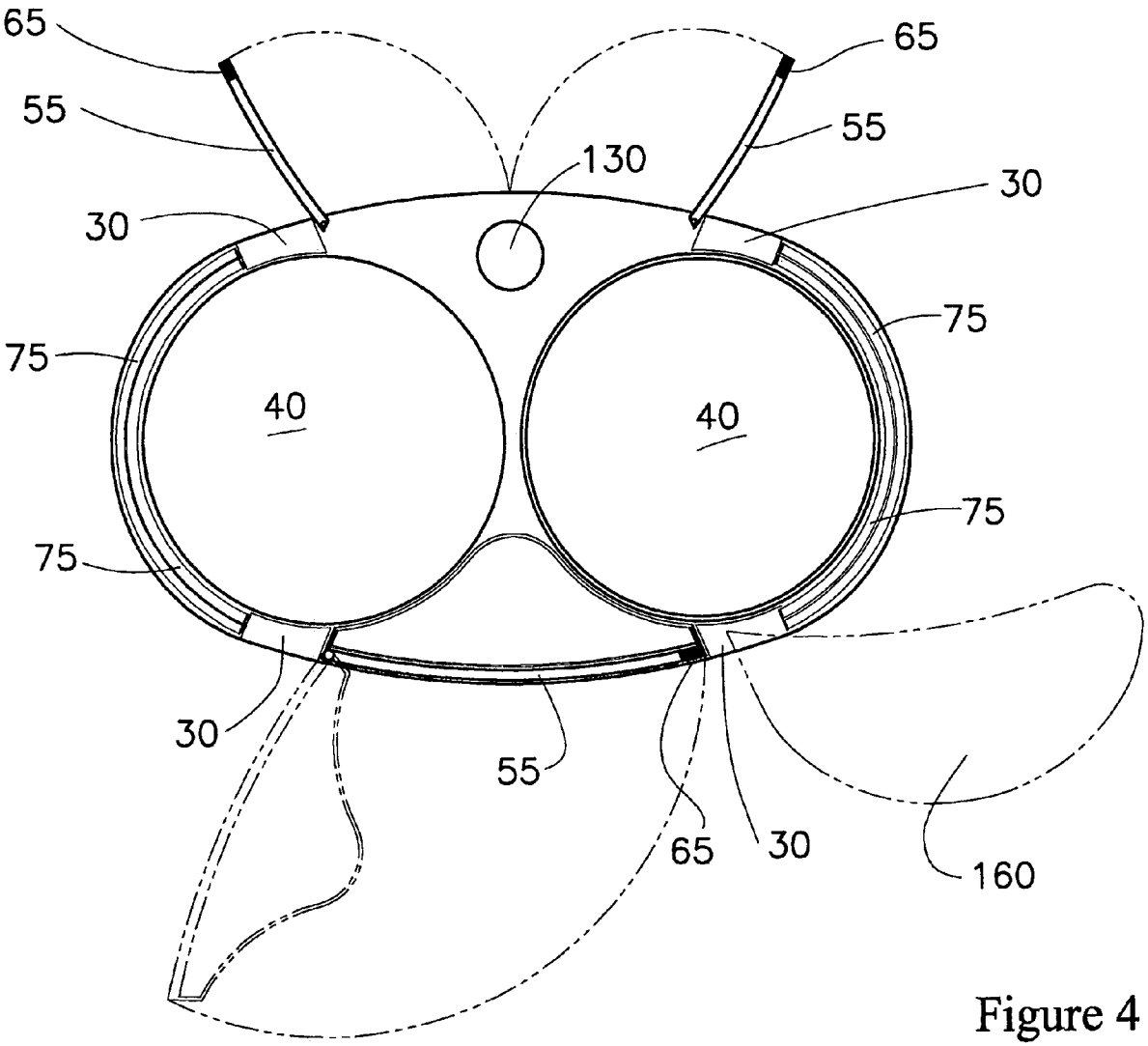
FIG. 4 is a sectional view of the refrigeration compartment of one embodiment of the refrigeration device of the present invention.
Figure 5:
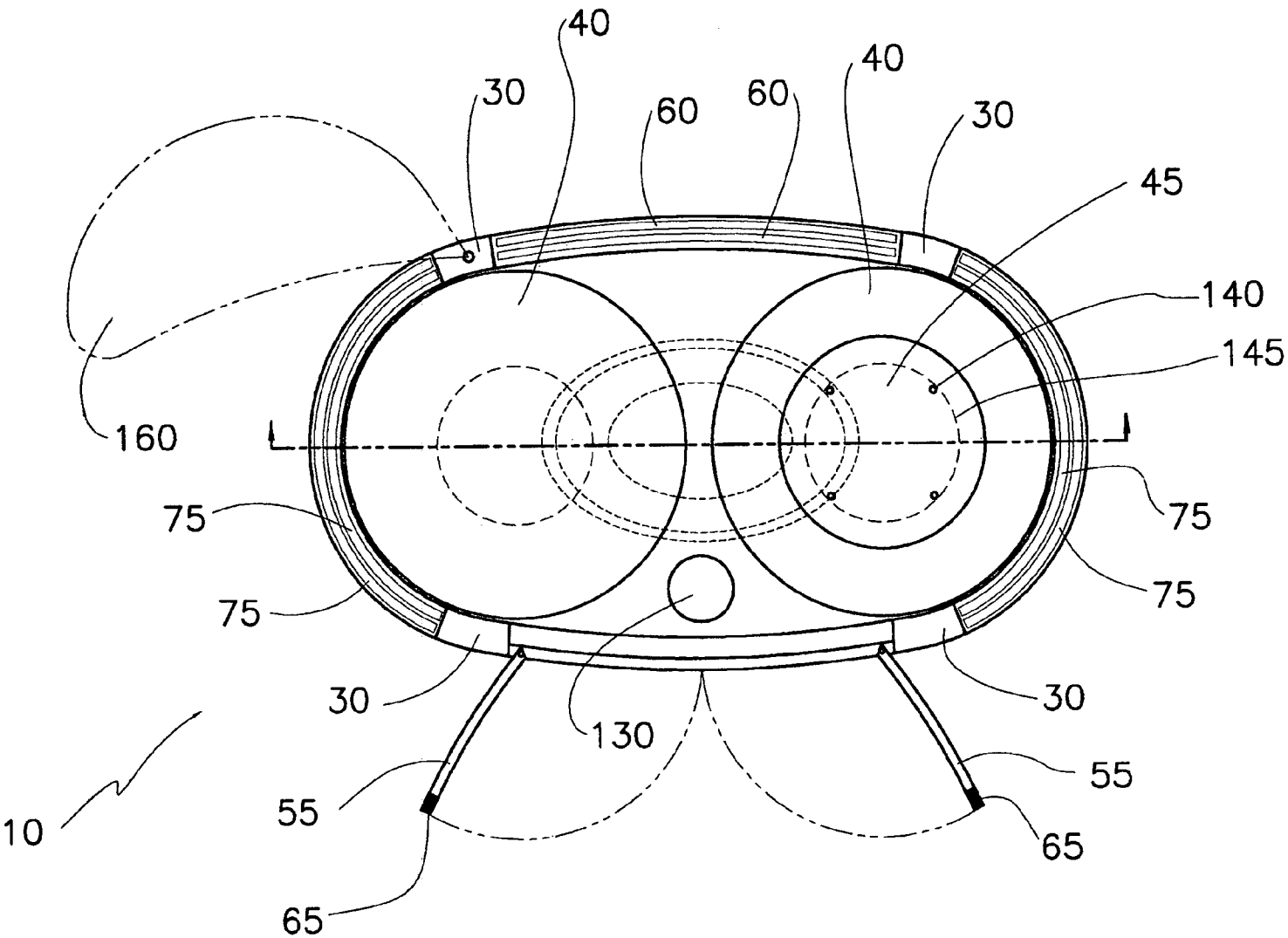
FIG. 5 is a sectional view of the refrigeration compartment of another embodiment of the refrigeration device of the present invention.

Referring now to FIGS. 4 and 5, each planar side section 50 of the refrigeration compartment's sidewall portion 30 includes at least one door member. The side section's door member may be a hinged door member 55, as illustrated in FIGS. 4 and 5, or a pair of sliding door members 60, as illustrated in FIG. 5. In one embodiment which has a single, planar, hinged door members 55 in each planar side section 50, the hinged door members 55 each pivot at one door side on a vertical axis, as illustrated in FIG. 4. Preferably, the hinged door members 55 are positioned opposite each other, one on each planar, side section 50 of the elliptical refrigeration compartment 15, with each hinged door member 55 opening outwardly from the refrigeration compartment 15. When open, the door members 55 each provide access to the two separate, planar, first shelving members 40 interior the refrigeration compartment 15. Rotation of the shelving members 40 provides access to items positioned thereon from either open door member 55. Likewise, a rotatable, planar, second shelving member 45 positioned in register above each planar, first shelving member 40, and rotatable about the vertical axis of rotation of the first shelving member 40 there beneath, is accessible from each hinged door member 55. With hinged door members 55 on both side sections 50 of the refrigeration compartment 15, access to the rotatable shelving members 40, 45 is available from either side of the compartment 15. All hinged door members 55 include a peripheral seal member 65 that abuts the edges of the refrigeration compartment 15, to minimize air leakage from interior the compartment 15.

In an alternative embodiment of the invention illustrated in FIGS. 4 and 5, each planar, side section 50 of the refrigeration compartment's sidewall portion 30 includes a pair of planar, hinged door members 55, with each hinged door member 55 pivoting at one door side on a vertical axis. In this embodiment, illustrated in FIGS. 1 and 2, the pair of hinged door members 55 includes adjacent edges and opposite edges, with each door member 55 of the pair hinged at an opposite edge with the adjacent edges of the doors moving outwardly from the refrigeration compartment 15 when opened. With the adjacent edges of a pair of door members 55 positioned approximately at the center of each planar, side section 50 of the sidewall 30, one door member 55 of the pair is opened to selectively access items located on one of the first shelving members 40 and an associated second shelving member 45. With hinged door members 55 on both side sections 50 of the refrigeration compartment 15, access to the rotatable shelving members 40, 45 is available from either side of the compartment 15. All hinged door members 55 include a peripheral seal member 65 that abuts the edges of the refrigeration compartment 15, to minimize air leakage from interior the compartment 15.

In another alternative embodiment illustrated in FIG. 5, the side section's door members include a pair of planar, sliding door members 60. In this embodiment, the sliding door members 60 are configured as overlapping panels traveling in separate, opposed tracks 70, located in the refrigeration compartment's top portion 20 and bottom portion 25, as illustrated in FIG. 1. The sliding door members 60 each have a surface area slightly larger than half the door opening, thereby overlapping to seal the door opening. A seal 65 is provided in the overlap area of the pair of sliding door members 60 to minimize cold air leaking from the refrigeration compartment 15. Likewise, a seal 65 is provided in the opposed tracks 70 for the same purpose. In the sliding door configuration, each of the rotatable first and second shelving members 40, 45 are selectively accessible by moving just one of the pair of sliding door member 60.

In yet another alternative embodiment, the door members of the two side sections may include a single hinged door member 55 or a pair of hinged door member 55, plus one pair of sliding door members 60, as illustrated in FIG. 5. This combination provides a great deal of flexibility in accessing the shelving members 40, 45 within the refrigeration compartment 15, as well as in cleaning the interior thereof.

Although the hinged door member 55 and the sliding door member 60 may be opaque, it is highly preferred that all such door members be transparent to allow viewing of the contents of the refrigeration compartment 15. Because there are multiple access doors to the compartment 15, much time can be saved by viewing the compartment's contents before selecting which door to access. Similarly, loss of cooling air from interior the refrigeration compartment 15 is minimized by opening a single door to access an item within the compartment 15.

Figure 14:
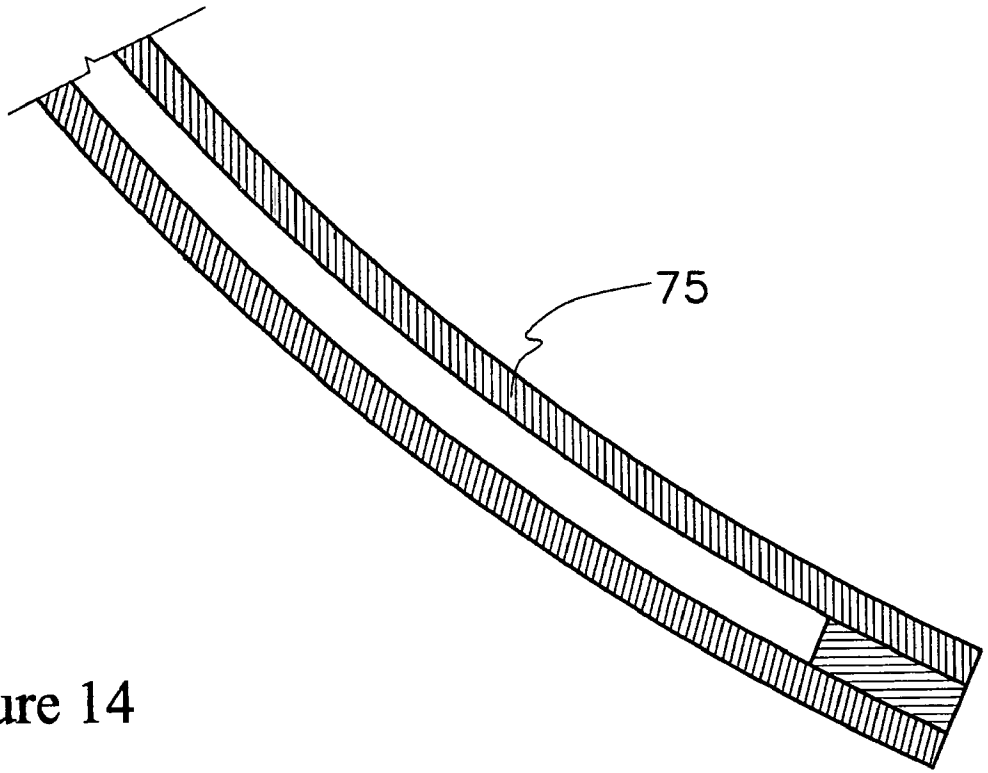
FIG. 14 is a horizontal cross sectional view of the curved, transparent door members of one embodiment of the refrigeration device of the present invention.

A polycarbonate sheet material provides suitable transparency for the refrigeration chamber's doors, 55, 60. In order to provide improved insulating properties for such doors, two sheets of polycarbonate material are sandwiched around a peripheral spacer to produce a trapped air space between the sheets. This air space provides suitable insulating properties for the transparent doors having the sandwich configuration. A vertical cross section of the side section's door members 55 is shown in FIG. 14.

Referring again to FIGS. 1–3, the compartment's sidewall curved end sections 35 each including a pair of curved, sliding door members 75. The curved, sliding door members 75 are configured as overlapping panels traveling in separate, opposed tracks 70, located in the compartment's top portion 20 and bottom portion 25. The curved sliding door members 75 conform to the curvature of the elliptical refrigeration compartment 15, and each sliding door member 75 slides into registry with the other sliding door member 75 of the pair. As with the planar, sliding door members 60, a seal 65 is provided in the overlap area of the pairs of sliding door members 75 to minimize cold air leaking from the refrigeration compartment 15. Likewise, a seal 65 is provided in the opposed tracks 70 for the same purpose. Each curved sliding door member 75 provides access to one of the separate, planar, first shelving members 40 and a second shelving member 45 positioned above the first shelving member 40.

Although the curved, sliding door members 75 may be opaque, it is highly preferred that all such door members be transparent to allow viewing of the contents of the refrigeration compartment 15. A polycarbonate sheet material provides suitable transparency for the refrigeration chamber's curved, sliding door member 75, as well. In order to provide improved insulating properties for such doors, two sheets of polycarbonate material are sandwiched around a peripheral spacer to produce a trapped air space between the sheets. This air space provides suitable insulating properties for the doors having the sandwich configuration. The polycarbonate sheet material is heat formed to produce the proper curvature for the curved, sliding door members 75 prior to fabrication of the sandwich configuration. A horizontal cross section of the curved end section's sliding door members 75 is shown in FIG. 14.

Figure 7:
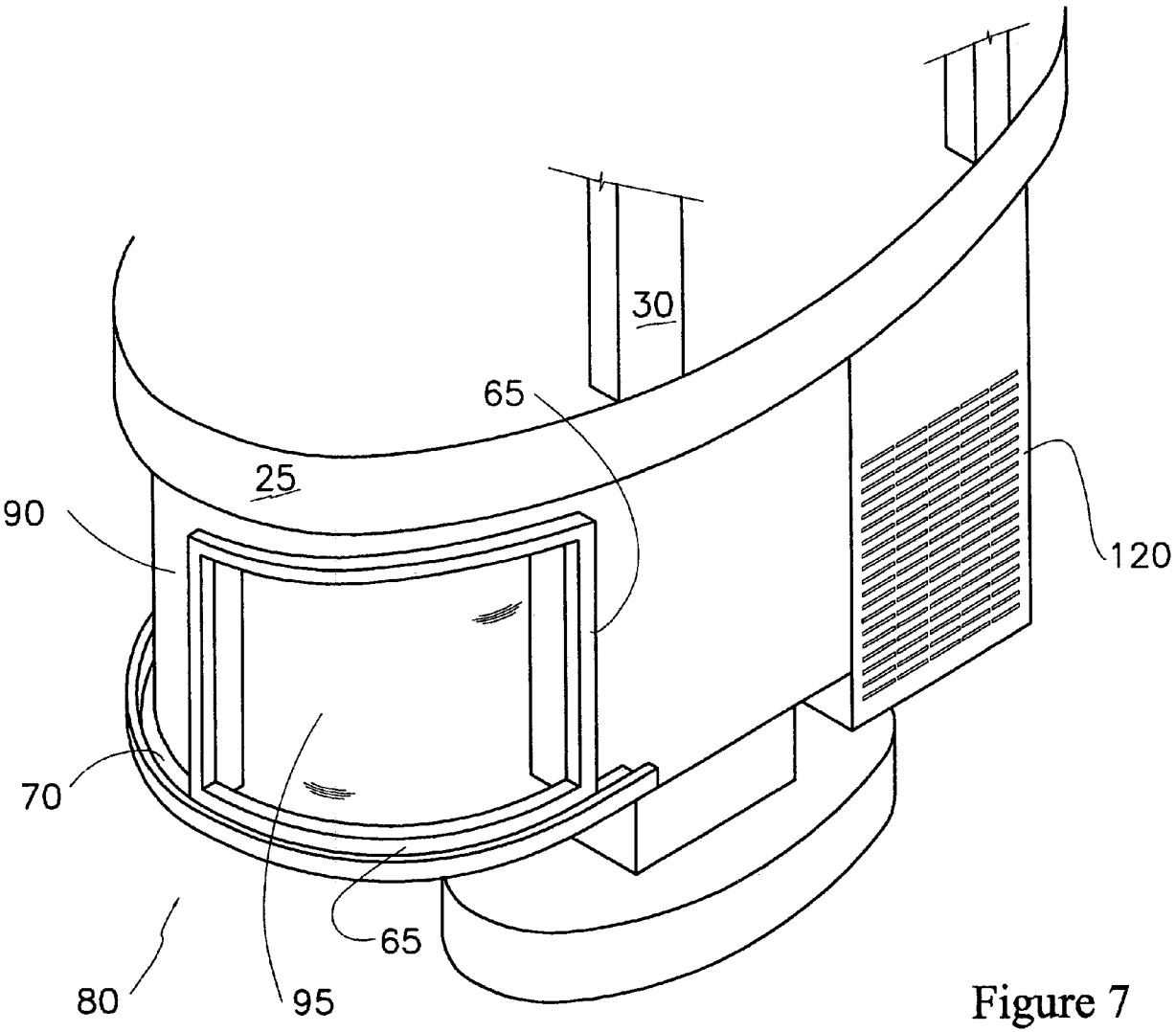
FIG. 7 is a perspective end view of the freezer compartment of one embodiment of the refrigeration device of the present invention.
Figure 8:
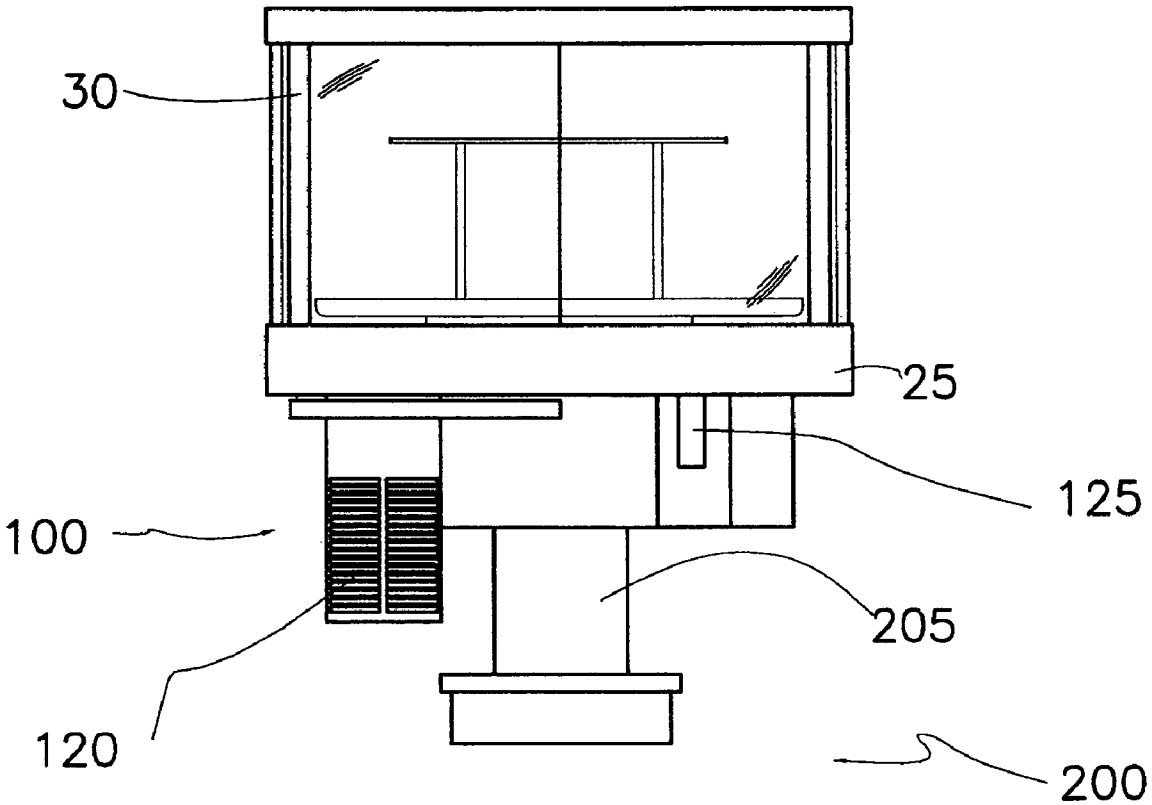
FIG. 8 is a perspective end view opposite the freezer compartment of one embodiment of the refrigeration device of the present invention.

In a further embodiment of the invention, a freezer compartment 80 is secured to the refrigeration compartment 15. As illustrated in FIGS. 7 and 8, the freezer compartment 80 is secured to the bottom portion 25 of the refrigeration compartment 15 adjacent one curved end section 35 of the vertical sidewall portion 30. The freezer compartment 80 includes a vertical sidewall 85 having a curved end section 90 with a curved freezer door member 95 therein for accessing the freezer compartment 80. In one embodiment, the curved freezer door member 95 is a hinged door member pivoting at one door side on a vertical axis. In another embodiment, illustrated in FIG. 7, the curved freezer door member 95 is a sliding door member that moves in opposed tracks 70 secured above and below the freezer door member 95. Most preferably, the freezer door member 95 is fabricated from a transparent material to allow viewing of the items within the freezer compartment 80 from the exterior. The transparent material is preferably a polymeric resin substance with suitable insulating properties, such as polycarbonate sheet material formed into a sandwich configuration, as described above and illustrated in FIG. 14. Suitable seals 65 are provided around the curved freezer door member 95 to minimize leakage of cold air from interior the freezer compartment 80 with the door member 95 closed.

Figure 9:
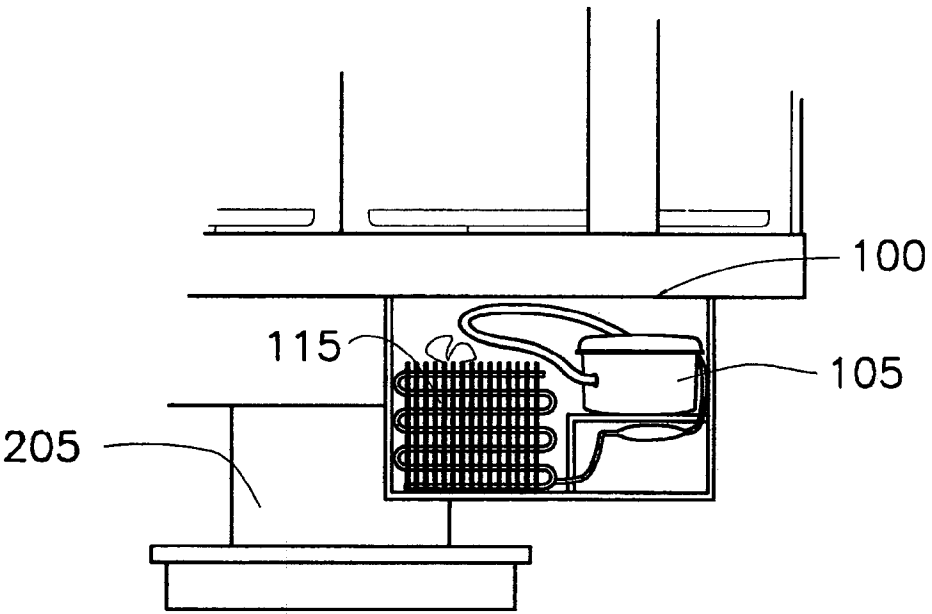
FIG. 9 is a side view of the powered refrigeration unit of one embodiment of the refrigeration device of the present invention.
Figure 10:
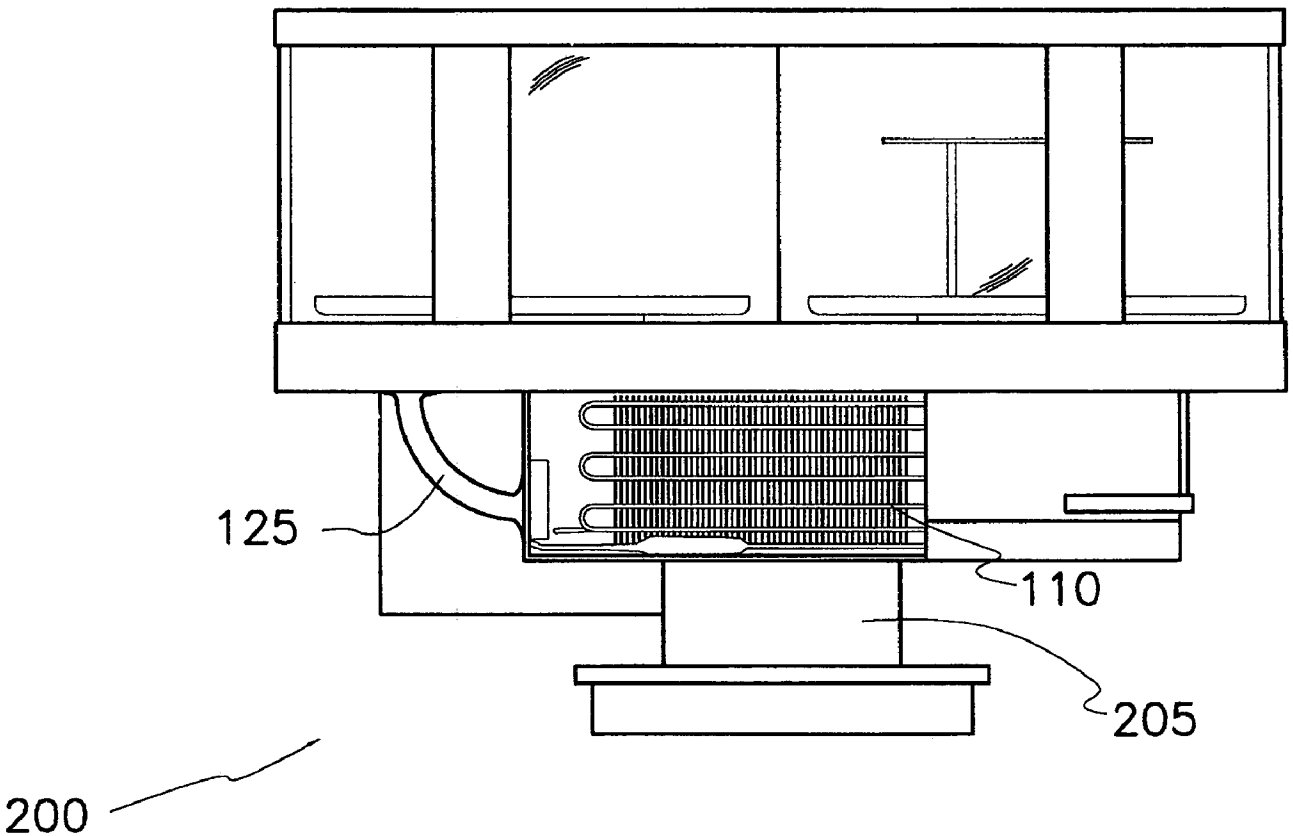
FIG. 10 is a perspective view of the evaporator cooling section of one embodiment of the refrigeration device of the present invention.

Referring now to FIGS. 9–10, a powered refrigeration unit 100 provides cooling for the refrigeration device 10. The powered refrigeration unit 100 includes a compressor system 105 with refrigeration fluid circulating through an evaporator cooling section 110 and a condenser section 115. The refrigeration unit 100 provides cooling for the refrigeration compartment 15 and the freezer compartment 80. In the embodiment shown in FIGS. 9–10, the powered refrigeration unit 100 is located in a housing 120 attached to the refrigeration compartment 15 and the freezer compartment 80. The housing 120 and the internal refrigeration unit 100 may be located below the refrigeration compartment 15 and opposite the freezer compartment 80, as illustrated, or the housing 120 and the internal refrigeration unit 100 may be located above the refrigeration compartment 15. Alternatively, the powered refrigeration unit 100 can be located in a housing 120 remote from the refrigeration chamber 15 and the attached freezer compartment 80, similar to an air conditioner system operated in conjunction with a forced air heating system for a residential dwelling. The refrigeration fluid is transferred to and from the refrigeration device 10, via suitable conduit connected to the powered refrigeration unit 100. In the remote refrigeration unit configuration, the refrigeration fluid conduit is preferably routed interior the vertical support member 200 to and from the refrigeration compartment 15 and the freezer compartment 80.

Referring now to FIG. 9, the evaporator cooling section 110 of the refrigeration unit 100 is located within the unit's housing 120. Air from the refrigeration chamber 15 is drawn via a return air conduit 130, seen in FIG. 8, to the evaporator cooling section 110. After contacting the cooling section 110, the cooled air is routed back to the refrigeration chamber 15 via a cold air conduit 125, seen in FIG. 8. The cold air conduit 125 enters the refrigeration chamber 15 beneath one or both of the rotatable first shelving members 40. As with all refrigeration devices, a suitable thermostat is provided to select and maintain the desired operating temperature for the refrigeration compartment 15 and attached freezer compartment 80.

A vertical support member 200 is secured to the refrigeration compartment 15 for positioning the refrigeration compartment 15 and attached freezer compartment 80 a selected distance above a support surface. In one embodiment of the invention, the vertical support member 200 is secured to the refrigeration compartment's bottom portion 25 to provide pedestal support for the refrigeration unit 10. In another embodiment of the invention, the vertical support member 200 is secured to the refrigeration compartment's top portion 20 to provide hanging support for the refrigeration unit 10.

Figure 11:
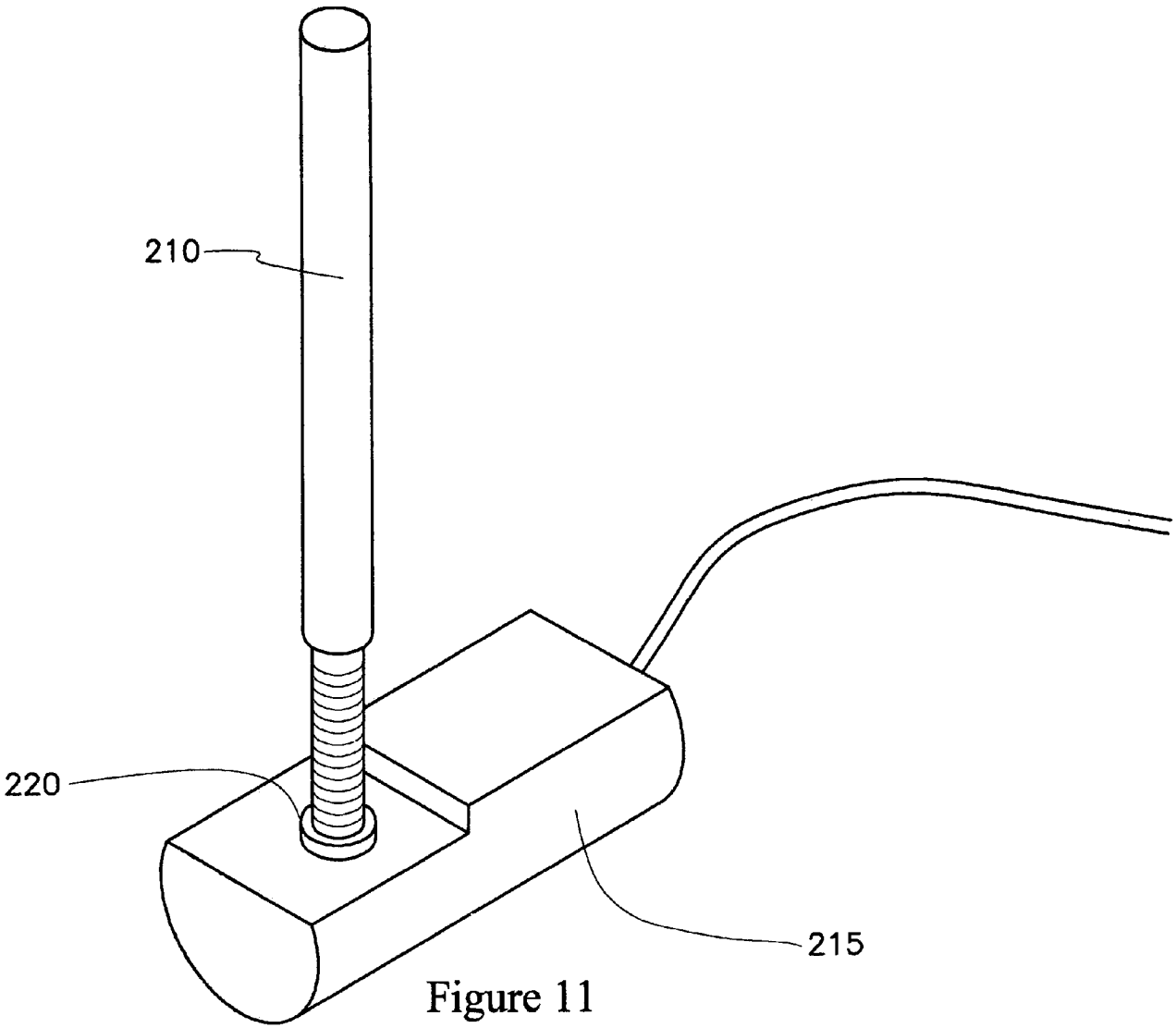
FIG. 11 is perspective view of the telescoping mechanism of the vertical support member of one embodiment of the refrigeration device of the present invention.

In a further embodiment of the invention, the vertical support member 200 includes a telescoping structure 205 to raise and lower the refrigeration compartment 15 and attached freezer compartment 80, as needed, with the vertical support member 200 functioning either as a pedestal support or as a hanging support. Preferably, the telescoping structure 205 includes a linear actuator 210, an electric motor 215 and a screw drive assembly 220, operable to lengthen or shorten the vertical support member 200, as needed. These three elements 210, 215, 220 of the telescoping structure 205 are shown in FIG. 11.

In yet a further embodiment of the invention, an extendable shelf member 160 is secured to the exterior of the bottom portion 25 of the refrigeration compartment 15. The extendable shelf member 160 slides outwardly from the compartment 15 to provide a temporary support for items entering or exiting the refrigeration compartment 15. The shelf member 160 preferably rides on rails that are secured to the bottom portion 20 of the refrigeration compartment 15. Additionally, the shelf member 160 may include a support leg member 165 secured at one end to the bottom side of the shelf member 160. The support leg member 165 is adjustable in length to provide support for the shelf member 160, with the support leg member in contact with the floor of the room housing the refrigeration device 10.

Figure 12:
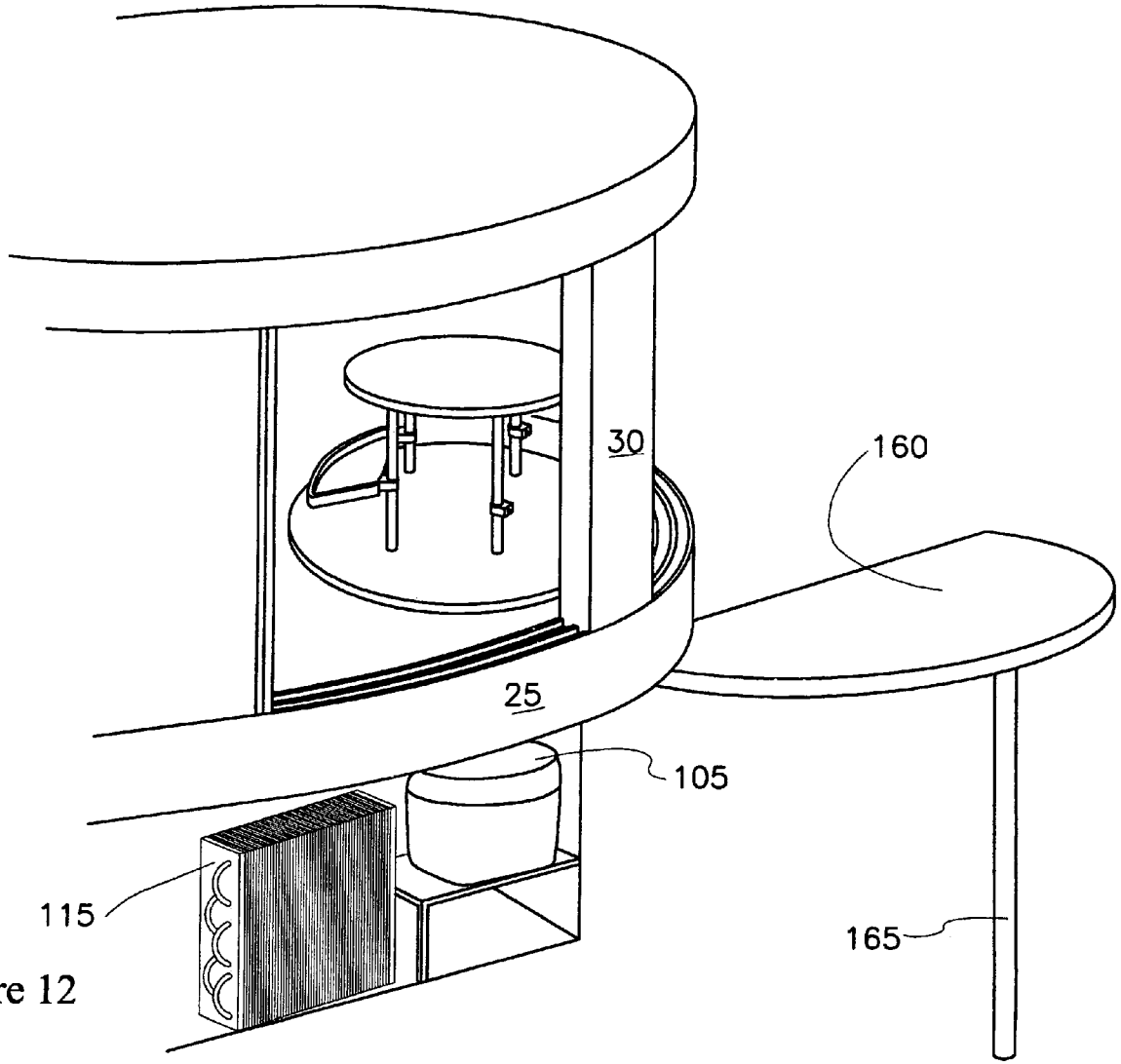
FIG. 12 is a perspective view of the adjustable shelf member of one embodiment of the refrigeration device of the present invention.
Figure 13:
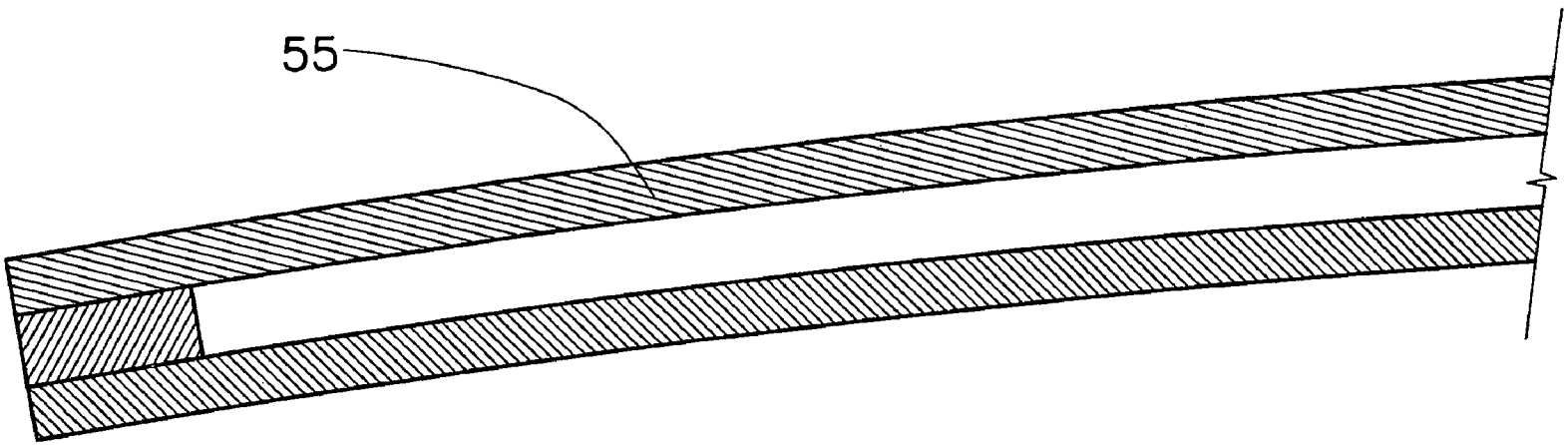
FIG. 13 is a vertical cross sectional view of the transparent door members of one embodiment of the refrigeration device of the present invention.

In yet a further embodiment of the invention, the shelf member 160 may be pivotally secured to the bottom portion 20 of the refrigeration compartment 15, allowing the shelf member 160 to pivot from a stored position beneath the bottom portion 25 of the refrigeration compartment 15 to a use position exterior the refrigeration compartment 15, as illustrated in FIGS. 4, 5 and 12. Likewise, the shelf member 160 may include a support arm member 165 secured at one end to the bottom side of the shelf member 160. The support arm member 165 is adjustable in length to provide support for the shelf member 160, with the support arm member in contact with the floor of the room housing the refrigeration device 10.

Figure 6:
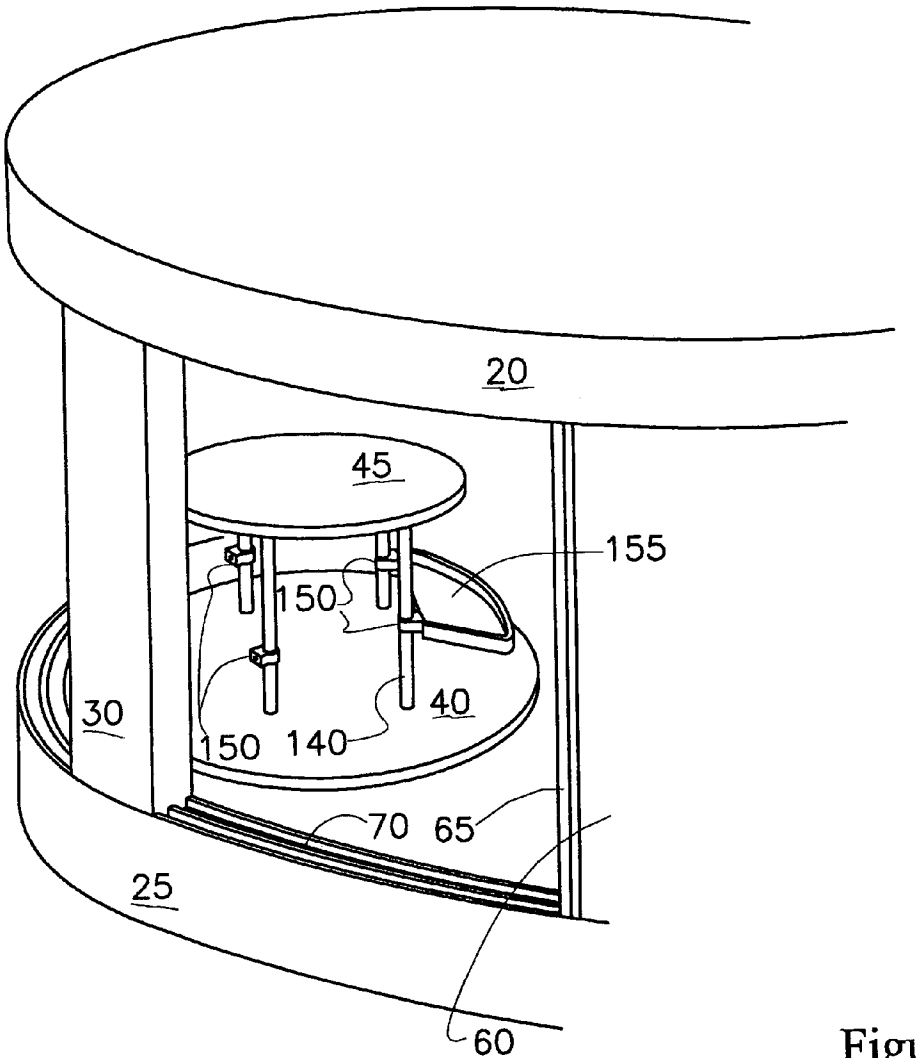
FIG. 6 is a perspective view of the first and second shelving members of one embodiment of the refrigeration device of the present invention.

Referring now to FIG. 6, the vertical rod members 140 supporting the rotatable second shelving member 45 above the rotatable first shelving member 40 provide points of attachment for adjustable shelving members 155. Slidable clip members 150 moveably attached to the vertical rod members 140 support the small shelving members 155. The small shelving members 155 can be positioned at selected levels between the first and second shelving members 40, 45 to provide additional storage for smaller items.

The refrigeration compartment 15 may be further modified to include solenoids or motors to open and close the hinged door members 55 and to rotate the planar first shelving members 40, and any associated second shelving members 45, within the refrigeration compartment 15. Preferably, the solenoids or motors are controlled by a wireless activation unit that can be located at a distance from the refrigeration device 10.

Additionally, the refrigeration device 10 may include a microprocessor to control opening and closing of the hinged door members 55, the raising and lowering of the refrigeration compartment 15. The microprocessor also provides audio messages to assist in locating the refrigeration compartment 15 and to alert the user to faulty operation, such as the hinged door members 55 or sliding door members 60, 75 being open for an extended period, as well as high/low temperatures within the refrigeration compartment 15.

The descriptions above and the accompanying materials should be interpreted in the illustrative and not the limited sense. While the invention has been disclosed in connection with the preferred embodiment or embodiments thereof, it will be understood by those skilled in the art that various changes in form and details may be made therein without departing from the spirit and scope of the invention.

We claim:

1. A refrigeration device comprising:

a refrigeration compartment having an elliptical cross-section, with planar, horizontal top and bottom portions and with a vertical sidewall having opposed, curved end sections and opposed, essentially planar, side sections;

the refrigeration compartment including two separate, planar first shelving members positioned therein adjacent the compartment bottom portion, each first shelving member rotatable about a separate vertical axis;

each sidewall planar side section including at least one door member each providing access to the at least two separate, planar shelving member;

the sidewall curved end sections each including a pair of curved, sliding door members, each sliding door member providing access to one of the at least two separate, planar shelving members;

a powered refrigeration unit including a compressor system with refrigeration fluid circulating through an evaporator cooling section and a condenser section, the refrigeration unit providing cooling for the refrigeration compartment; and a vertical support member secured to the refrigeration compartment for positioning the refrigeration compartment a selected distance above a support surface.

2. The refrigeration device according to claim 1, wherein the side section's at least one door member and the end section's pair of pair of curved, sliding door members are transparent to allow viewing items interior the refrigeration compartment.

3. The refrigeration device according to claim 2, wherein the transparent doors include parallel polycarbonate sheets with an insulating air space confined there between.

4. The refrigeration device according to claim 1, wherein each side section's at least one door member includes a hinged door member pivoting at one door side on a vertical axis.

5. The refrigeration device according to claim 4, wherein each side section's at least one door member includes a pair of hinged door member each pivoting at one door side on a vertical axis.

6. The refrigeration device according to claim 1, wherein each side section's at least one door member includes a pair of overlapping, sliding door members traveling in separate, opposed tracks located in the refrigeration compartment's top portion and bottom portion.

7. The refrigeration device according to claim 1, further including a freezer compartment secured to the refrigeration compartment, the freezer compartment including a vertical sidewall having a curved end section with a curved freezer door member therein for accessing the freezer compartment.

8. The refrigeration device according to claim 7, wherein the freezer compartment is secured to the bottom portion of the refrigeration compartment adjacent one curved end section of the vertical sidewall.

9. The refrigeration device according to claim 1, wherein the freezer door member is a hinged door member pivoting at one door side on a vertical axis.

10. The refrigeration device according to claim 1, wherein the freezer door member is a sliding door member.

11. The refrigeration device according to claim 1, wherein the freezer door member is transparent to allow viewing items interior the freezer compartment.

12. The refrigeration device according to claim 1, wherein the vertical support member is secured to the refrigeration compartment bottom portion for pedestal support.

13. The refrigeration device according to claim 1, wherein the vertical support member is secured to the refrigeration compartment top portion for hanging support.

14. The refrigeration device according to claim 1, wherein the vertical support member includes a telescoping structure to raise and lower the refrigeration compartment.

15. The refrigeration device according to claim 14, wherein the telescoping structure of the vertical support member includes a linear actuator, an electric motor and a screw drive assembly to raise and lower the refrigeration compartment.

16. The refrigeration device according to claim 1, wherein the powered refrigeration unit is located in a housing attached to the refrigeration compartment.

17. The refrigeration device according to claim 1, wherein the powered refrigeration unit is located in a housing remote from the refrigeration compartment and attached freezer compartment.

18. The refrigeration device according to claim 1, further including an inlet air conduit delivering cold air to the refrigeration compartment from the refrigeration unit and a return air conduit recycling air from the refrigeration compartment to the refrigeration unit.

19. The refrigeration device according to claim 1, wherein the rotatable planar first shelving members within the refrigeration compartment are round.

20. The refrigeration device according to claim 1, further including a planar, second shelving member positioned in register above each first planar shelving member, each second shelving member rotatable about the vertical axis of rotation of the first shelving member there beneath.

21. The refrigeration device according to claim 20, further including a plurality of vertical rod members extending between the first and second shelving members, each rod member including a slidable clip member there upon, with an adjustable shelf member secured to the slidable clip member.

22. A refrigeration device comprising:

a refrigeration compartment having an elliptical cross-section, with planar, horizontal top and bottom portions and with a vertical sidewall having opposed, curved end sections and opposed, essentially planar, side sections;

the refrigeration compartment including two separate, planar first shelving members positioned therein adjacent the compartment bottom portion, each first shelving member rotatable about a separate vertical axis;

each sidewall planar side section including at least one door member each providing access to the at least two separate, planar shelving member;

the sidewall curved end sections each including a pair of curved, sliding door members, each sliding door member providing access to one of the at least two separate, planar shelving members;

a freezer compartment secured to the refrigeration compartment, the freezer compartment including a vertical sidewall having a curved end section with a curved freezer door member therein for accessing the freezer compartment;

a powered refrigeration unit including a compressor system with refrigeration fluid circulating through an evaporator cooling section and a condenser section, the refrigeration unit providing cooling for the refrigeration compartment and the freezer compartment; and a vertical support member secured to the refrigeration compartment for positioning the refrigeration compartment and attached freezer compartment a selected distance above a support surface.

23. The refrigeration device according to claim 22, wherein the side section's at least one door member, the end section's pair of pair of curved, sliding door members and the freezer door member are transparent to allow viewing items interior the refrigeration compartment and the freezer compartment.

24. The refrigeration device according to claim 23, wherein the transparent doors include parallel polycarbonate sheets with an insulating air space confined there between.

25. The refrigeration device according to claim 22, wherein each side section's at least one door member includes a hinged door member pivoting at one door side on a vertical axis.

26. The refrigeration device according to claim 25, wherein each side section's at least one door member includes a pair of hinged door member each pivoting at one door side on a vertical axis.

27. The refrigeration device according to claim 22, wherein each side section's at least one door member includes a pair of overlapping, sliding door members traveling in separate, opposed tracks located in the refrigeration compartment's top portion and bottom portion.

28. The refrigeration device according to claim 22, wherein the freezer compartment is secured to the bottom portion of the refrigeration compartment adjacent one curved end section of the vertical sidewall.

29. The refrigeration device according to claim 22, wherein the freezer door member is a hinged door member pivoting at one door side on a vertical axis.

30. The refrigeration device according to claim 22, wherein the freezer door member is a sliding door member.

31. The refrigeration device according to claim 22, wherein the vertical support member is secured to the refrigeration compartment bottom portion for pedestal support.

32. The refrigeration device according to claim 22, wherein the vertical support member is secured to the refrigeration compartment top portion for hanging support.

33. The refrigeration device according to claim 22, wherein the vertical support member includes a telescoping structure to raise and lower the refrigeration compartment.

34. The refrigeration device according to claim 33 wherein the telescoping structure of the vertical support member includes a linear actuator, an electric motor and a screw drive assembly to raise and lower the refrigeration compartment.

35. The refrigeration device according to claim 22, wherein the powered refrigeration unit is located in a housing attached to the refrigeration compartment.

36. The refrigeration device according to claim 22, wherein the powered refrigeration unit is located in a housing remote from the refrigeration compartment and attached freezer compartment.

37. The refrigeration device according to claim 22, further including an inlet air conduit delivering cold air to the refrigeration compartment from the refrigeration unit and a return air conduit recycling air from the refrigeration compartment to the refrigeration unit.

38. The refrigeration device according to claim 22, wherein the rotatable planar first shelving members within the refrigeration compartment are round.

39. The refrigeration device according to claim 22, further including a planar, second shelving member positioned in register above each first planar shelving member, each second shelving member rotatable about the vertical axis of rotation of the first shelving member there beneath.

40. The refrigeration device according to claim 39, further including a plurality of vertical rod members extending between the first and second shelving members, each rod member including a slidable clip member there upon, with an adjustable shelf member secured to the slidable clip member.

41. A refrigeration device comprising:

a refrigeration compartment having an elliptical cross-section, with planar, horizontal top and bottom portions and with a vertical sidewall having opposed, curved end sections and opposed, essentially planar, side sections;

the refrigeration compartment including two separate, planar first shelving members positioned therein adjacent the compartment bottom portion, each first shelving member rotatable about a separate vertical axis;

each sidewall planar side section including at least one transparent door member each providing access to the at least two separate, planar shelving member;

the sidewall curved end sections each including a pair of transparent, curved, sliding door members, each sliding door member providing access to one of the at least two separate, planar shelving members;

a freezer compartment secured to the bottom portion of the refrigeration compartment adjacent one cured end section of the vertical sidewall, the freezer compartment including a vertical sidewall having a curved end section with a transparent, curved freezer door member therein for accessing the freezer compartment;

a powered refrigeration unit including a compressor system with refrigeration fluid circulating through an evaporator cooling section and a condenser section, the refrigeration unit providing cooling for the refrigeration compartment and the freezer compartment; and a telescoping, vertical support member secured to the bottom portion of the refrigeration compartment for positioning the refrigeration compartment and attached freezer compartment a selected distance above a support surface.

42. The refrigeration device according to claim 41, wherein the transparent doors include parallel polycarbonate sheets with an insulating air space confined there between.

43. The refrigeration device according to claim 41, wherein each side section's at least one door member includes a hinged door member pivoting at one door side on a vertical axis.

44. The refrigeration device according to claim 41, wherein each side section's at least one door member includes a pair of hinged door member each pivoting at one door side on a vertical axis.

45. The refrigeration device according to claim 41, wherein each side section's at least one door member includes a pair of overlapping, sliding door members traveling in separate, opposed tracks located in the refrigeration compartment's top portion and bottom portion.

46. The refrigeration device according to claim 41, wherein the freezer door member is a hinged door member pivoting at one door side on a vertical axis.

47. The refrigeration device according to claim 41, wherein the freezer door member is a sliding door member.

48. The refrigeration device according to claim 33 wherein the telescoping structure of the vertical support member includes a linear actuator, an electric motor and a screw drive assembly to raise and lower the refrigeration compartment.

49. The refrigeration device according to claim 41, wherein the powered refrigeration unit is located in a housing attached to the refrigeration compartment.

50. The refrigeration device according to claim 41, wherein the powered refrigeration unit is located in a housing remote from the refrigeration compartment and attached freezer compartment.

51. The refrigeration device according to claim 41, further including an inlet air conduit delivering cold air to the refrigeration compartment from the refrigeration unit and a return air conduit recycling air from the refrigeration compartment to the refrigeration unit.

52. The refrigeration device according to claim 41, wherein the rotatable planar first shelving members within the refrigeration compartment are round.

53. The refrigeration device according to claim 41, further including a planar, second shelving member positioned in register above each first planar shelving member, each second shelving member rotatable about the vertical axis of rotation of the first shelving member there beneath.

54. The refrigeration device according to claim 53, further including a plurality of vertical rod members extending between the first and second shelving members, each rod member including a slidable clip member there upon, with an adjustable shelf member secured to the slidable clip member.

* * * * *